US009073226B2

(12) United States Patent
Szczepanowski et al.

(10) Patent No.: US 9,073,226 B2
(45) Date of Patent: Jul. 7, 2015

(54) PIVOTING RAZOR

(75) Inventors: Andrew Anthony Szczepanowski, North Attleboro, MA (US); Kiyoshi Yokote, Kashiwa (JP)

(73) Assignee: The Gillette Company, Boston, MA (US)

( * ) Notice: Subject to any disclaimer, the term of this patent is extended or adjusted under 35 U.S.C. 154(b) by 315 days.

(21) Appl. No.: 13/343,750

(22) Filed: Jan. 5, 2012

(65) Prior Publication Data

US 2012/0198698 A1 Aug. 9, 2012

Related U.S. Application Data

(60) Provisional application No. 61/440,891, filed on Feb. 9, 2011.

(51) Int. Cl.

| | |
|---|---|
| ***B26B 21/00*** | (2006.01) |
| ***B26B 21/40*** | (2006.01) |
| ***B26B 21/22*** | (2006.01) |

(52) U.S. Cl.

CPC ..... *B26B 21/4012* (2013.01); *B26B 21/225* (2013.01)

(58) Field of Classification Search

USPC ..... 30/527, 532, 535, 536, 533, 50, 526

See application file for complete search history.

(56) References Cited

U.S. PATENT DOCUMENTS

| | | | | |
|---|---|---|---|---|
| 4,587,729 | A | 5/1986 | Jacobson | |
| 5,157,834 | A * | 10/1992 | Chen et al. | 30/532 |
| 5,784,790 | A * | 7/1998 | Carson et al. | 30/532 |
| 5,787,586 | A | 8/1998 | Apprille, Jr. et al. | |
| 5,956,851 | A | 9/1999 | Apprille, Jr. et al. | |
| 6,029,354 | A * | 2/2000 | Apprille et al. | 30/47 |
| 6,052,903 | A * | 4/2000 | Metcalf et al. | 30/40.2 |
| 6,085,426 | A * | 7/2000 | Metcalf et al. | 30/526 |
| 7,168,173 | B2 | 1/2007 | Worrick, III | |
| 7,197,825 | B2 | 4/2007 | Walker et al. | |
| 7,770,294 | B2 * | 8/2010 | Bruno et al. | 30/50 |
| 2002/0189112 | A1 * | 12/2002 | Peyser | 30/527 |

* cited by examiner

*Primary Examiner* — Omar Flores Sanchez

(74) *Attorney, Agent, or Firm* — Joanne N. Pappas; Kevin C. Johnson; Steven W. Miller

(57) ABSTRACT

A razor having a pivotable blade unit which is biased into a rest position by a biasing plunger. The razor includes a stabilizing bore in which a penetrating portion of the biasing plunger is configured to reciprocate. The largest cross-section of the penetrating portion has a shape which differs from the shape of the smallest cross-section of the stabilizing bore in order to lower the contact area between the penetrating portion of the biasing plunger and the stabilizing bore.

14 Claims, 10 Drawing Sheets

PIVOTING RAZOR

CROSS REFERENCE TO RELATED APPLICATION

This application claims the benefit of U.S. Provisional Application No. 61/440,891 filed 9 Feb. 2011.

FIELD OF THE INVENTION

The present invention relates to razors, particularly razors for shaving the body.

BACKGROUND OF THE INVENTION

In recent years razors with various numbers of blades have been proposed in the patent literature e.g. in U.S. Pat. No. 5,787,586, which generally describes a razor with a handle and cartridge connected thereto and is herein incorporated by reference. More recently, the combination of a pivoting blade unit with a spring-biased biasing plunger has been demonstrated in US Patent App. No. 20050198841, herein incorporated by reference, and commercialized as the Fusion razor by The Gillette Company. This reactively tilting blade unit has provided further advantages in the field by providing a razor that adapts to contours of the surface of the body to improve the closeness and comfort of shaving. The biasing plunger may be secured using a stabilizing bore in the razor, the perimeter of which serves to prevent lateral motion of the biasing plunger and so prevent it appearing loose and the razor poorly made. However, it may be possible for the biasing plunger to stick or jam in the bore from which it protrudes which reduces the efficiency with which the razor conforms to the body's surface thus reducing the closeness and comfort of shaving. Accordingly, there remains a need for a razor offering improved reliability in the function of the pivoting blade unit.

SUMMARY OF THE INVENTION

In a first embodiment, the present invention relates to a razor comprising a pivotable blade unit which is biased into a rest position by a biasing plunger, the razor comprising a stabilizing bore in which a penetrating portion of the biasing plunger is configured to reciprocate, wherein the largest cross-section of the penetrating portion has a shape which differs from the shape of the smallest cross-section of the stabilizing bore, in order to lower the contact area between the penetrating portion of the biasing plunger and the stabilizing bore.

In a second embodiment, the present invention relates to a razor comprising a pivotable blade unit which is biased into a rest position by a biasing plunger, the razor comprising a stabilizing bore defining an interior surface and in which a penetrating portion of the biasing plunger is configured to reciprocate; wherein the interior surface comprises at least one guiding groove or guiding protrusion and the biasing plunger comprises at least one guiding groove or guiding protrusion configured to fit with the guiding groove or guiding protrusion of the interior surface.

In a third embodiment, the present invention relates to a method of removing hair or bristles from a surface comprising the steps of providing a razor according to either the first or second embodiments and moving the razor across the surface.

In a fourth embodiment, the present invention relates to the use of a razor according to the first or second embodiments for the removal of hair or bristles.

In a fifth embodiment, the present invention relates to a kit comprising at least one razor according to the first or second embodiments and packaging for the at least one razor.

DETAILED DESCRIPTION OF THE INVENTION

The present invention relates to razors, particularly razors for shaving, or shaving razors.

Figure 1:
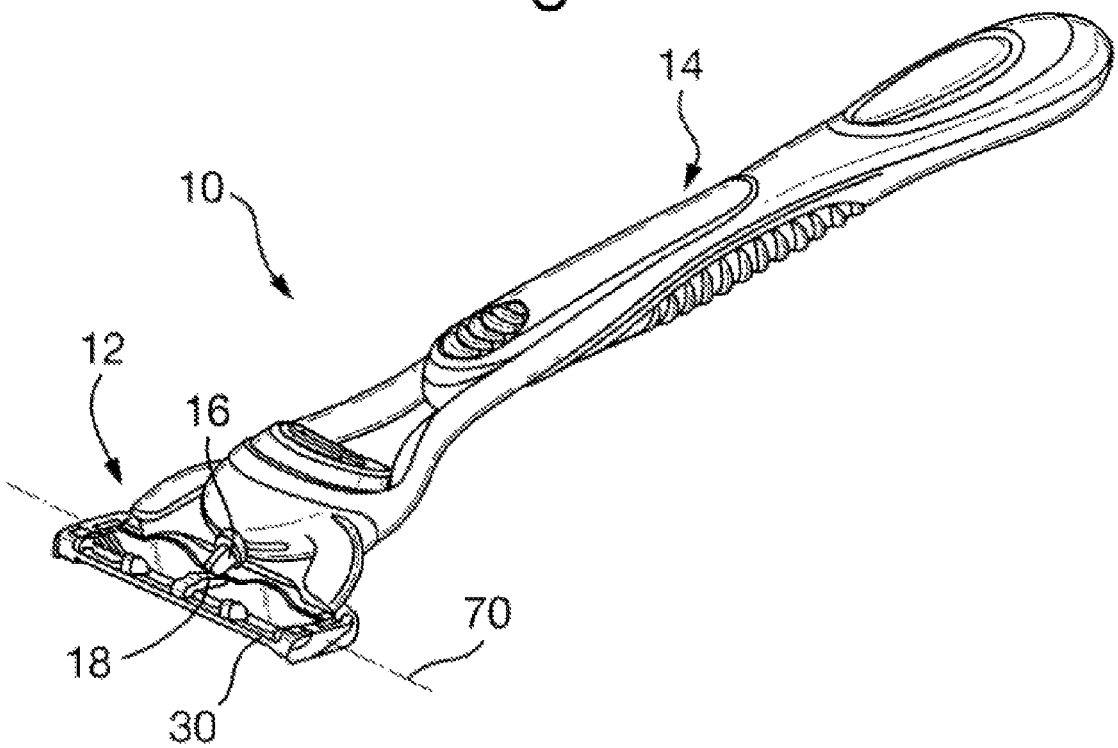
FIG. 1 is a perspective view of a razor.
Figure 2:
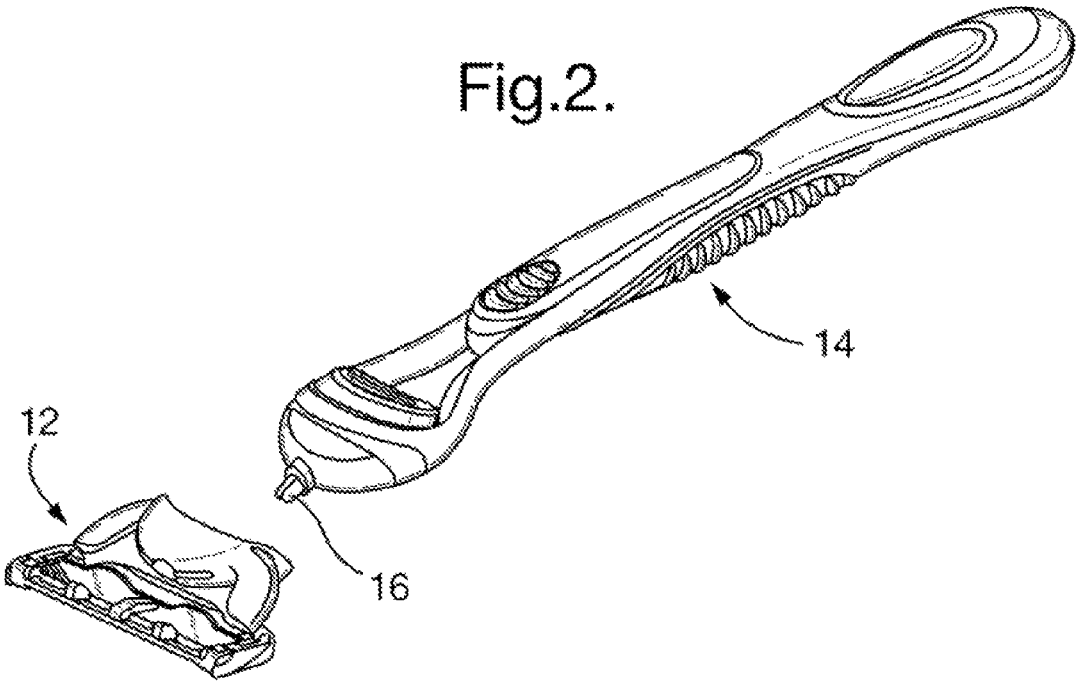
FIG. 2 is a perspective view of the razor of FIG. 1 with the blade unit disconnected from the handle.
Figure 2A:
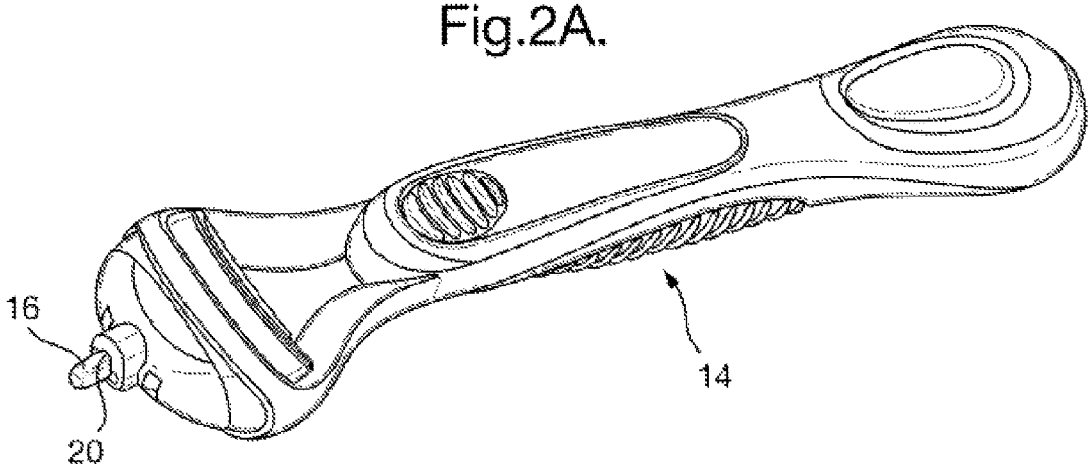
FIG. 2A is a perspective view of the handle of FIG. 2.
Figure 7:
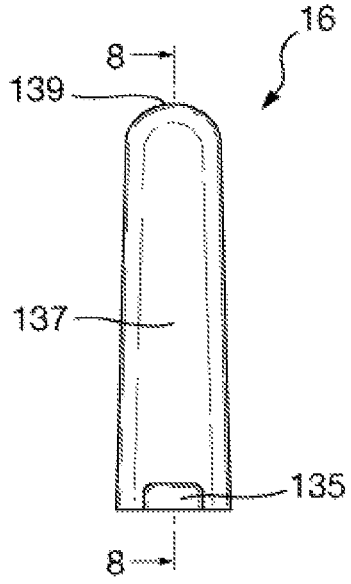
FIGS. 7 and 8 are front and section views of a biasing plunger.
Figure 8:
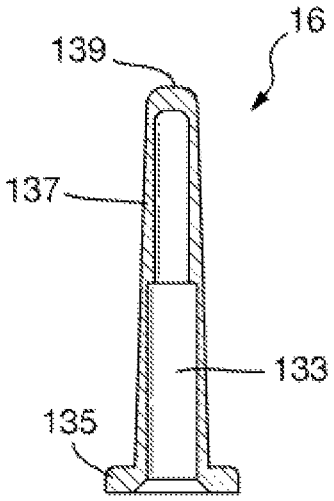

Referring to FIGS. 1, 2, 2A, 4 and 5, razor 10 includes blade unit 12 and may comprise an integrated or separate handle 14 (FIG. 2A). Blade unit 12 is pivotable and may pivot relative to the handle 14 around a pivot axis 70. Blade unit 12 may be releasably or permanently attached to handle 14. Razor 10 further comprises a biasing plunger 16 of which a penetrating portion is configured to reciprocate in or through a stabilizing bore 22 (FIGS. 9A and 11) in the razor 10 and which biases blade unit 12 into a rest position. Biasing plunger 16 is preferably biased in a direction towards the blade unit 12 and may contact a cam surface 18 on the blade unit 12. The biasing plunger 16 comprises a centrally located longitudinal axis, or length, defined in the direction of the line of its reciprocation (8 in FIG. 7) in use. As used herein, unless otherwise specified, any cross-section is taken in a plane perpendicular to this line. The penetrating portion comprises cross-sections taken in planes perpendicular to the longitudinal axis (8 in FIG. 7) that define a largest cross-section. The largest cross-section includes the outermost outline of the total cross-section when each of the cross-sections perpendicular to the longitudinal axis are superimposed keeping the position of the longitudinal axis constant, i.e. co-axially superimposed.

Figure 11:
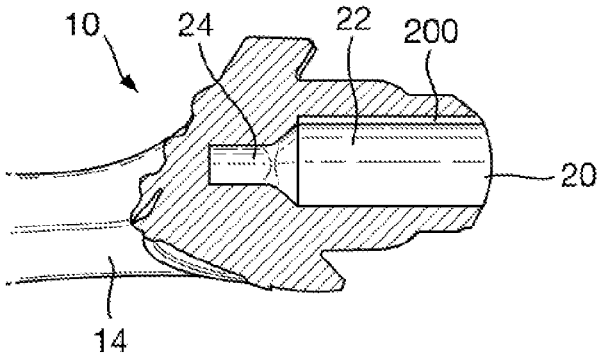
FIG. 11 is a section view of a handle of a razor.

Referring now to FIG. 11, razor 10 comprises a stabilizing bore 22 extending into at least a portion of razor 10, for example into handle 14. Stabilizing bore 22 at least partially defines an interior surface within the handle and comprises a first end at an opening 20 in the surface of handle 14 through which biasing plunger 16 (not shown) is biased to extend and a second end distal from opening 20. The stabilizing bore comprises cross-sections taken in planes perpendicular to the line of reciprocation of the biasing plunger, and including a smallest cross-section which comprises the innermost outline of the total cross-section when each of the cross-sections perpendicular to the longitudinal axis are co-axially superimposed.

Figure 9A:
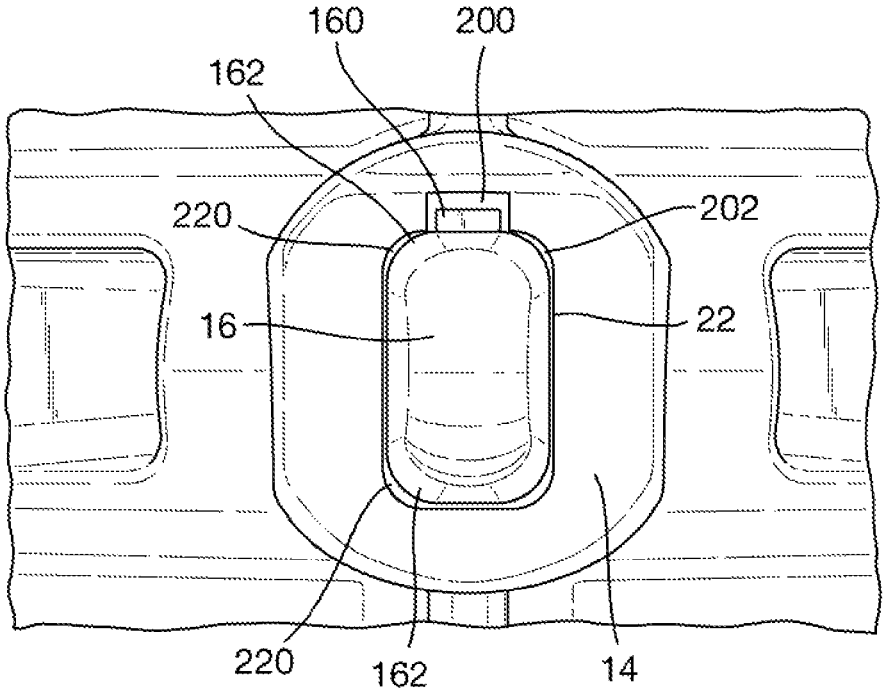
FIGS. 9A, 9B, and 9C are front views of handles of a razor.
Figure 9B:
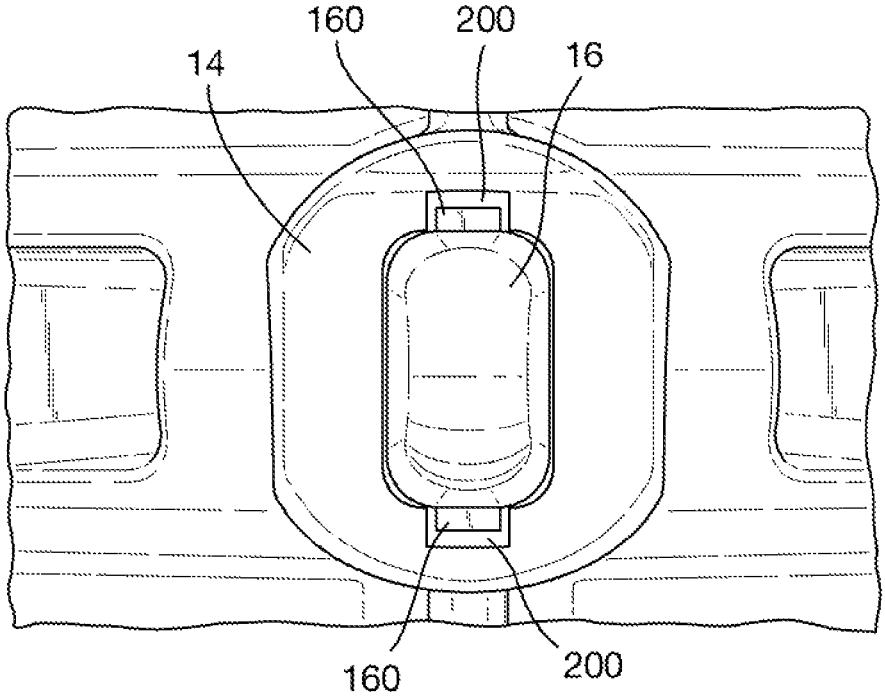
Figure 9C:
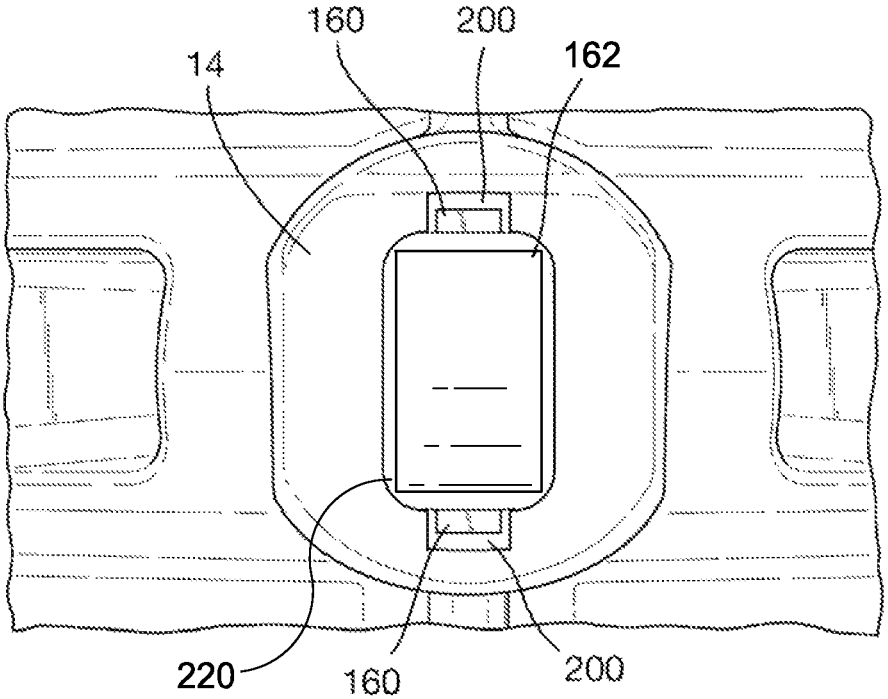

According to the first embodiment of the invention and referring to FIGS. 9A, 9B, and 9C, the largest cross-section of the penetrating portion of the biasing plunger has a shape which differs from the shape of the smallest cross-section of the stabilizing bore, such that the interior surface of stabilizing bore 22 is not equidistant from the side of biasing plunger 16 around its perimeter when the longitudinal axis of biasing plunger 16 is situated centrally within stabilizing bore 22. As used herein, any reference to a difference in shape does not relate simply to a change of size (i.e. a change in the length of all dimensions), rather to a change in at least one dimension within the shape, but not all of the dimensions. For example, a 1 cm×1 cm square and a 2 cm×2 cm square are both squares and therefore the same shape within the meaning above, but of a different size, one is larger than the other. Conversely, a 1 cm×2 cm rectangle is of a different shape to a 2 cm×2 cm square. It is understood, therefore, that in the context of the present invention, the stabilizing bore should be at least very slightly larger than the biasing plunger in order for the biasing plunger to be configured to pass through it. The aforementioned difference in shape lowers the contact area between biasing plunger 16 and stabilizing bore 22 and thus reduces the likelihood of biasing plunger 16 sticking within the stabilizing bore 22 in use. Applicants understand that increasing the length of the penetrating portion over which the shape of its cross-section is different to the shape of the smallest cross-section of the stabilizing bore 22 further decreases the likelihood of the biasing plunger 16 sticking in use by further reducing the possible contact area between the biasing plunger 16 and the perimeter of the stabilizing bore 22. In an advantageous embodiment, therefore, the cross-section of the penetrating portion is of a different shape to the smallest cross-section of the stabilizing bore throughout at least about 6%, preferably at least about 10%, more preferably at least about 30%, even more preferably at least about 50%, even more preferably still at least about 70%, yet more preferably at least about 90% and further preferably about 100% of the length of the penetrating portion.

In another advantageous embodiment, a distance between the largest cross-section of the penetrating portion of the biasing plunger 16 and the nearest point of the smallest cross-section of the stabilizing bore 22 is from about 0.01 mm to about 1 mm, preferably from about 0.03 mm to about 0.1 mm, more preferably about 0.04 mm to about 0.06 mm, and even more preferably from about 0.045 mm to about 0.055 mm when the longitudinal axis of the biasing plunger is situated centrally within the stabilizing bore. Further advantageously, every distance between the largest cross-section of the penetrating portion of the biasing plunger 16 and the nearest point of the smallest cross-section of the stabilizing bore 22 is within the range above. Applicants have found that too large a gap permits too much lateral motion of the biasing plunger 16 resulting in it being loose and operating inefficiently while too small a gap increases the likelihood of the biasing plunger 16 sticking. Particularly in combination with the preferred distances above, in a further preferred embodiment the biasing plunger is of a substantially consistent width perpendicular to its longitudinal axis over at least about 10% of its length, preferably at least about 30%, more preferably at least about 50%, even more preferably at least about 70% and even more preferably still at least about 80% of its length. The consistent width helps to keep the distance between the biasing plunger and the interior surface of the stabilizing bore within the preferred ranges specified above to further prevent lateral motion or sticking of the biasing plunger. The plunger's width may alternatively taper or otherwise vary over its length, although this in particular exacerbates the problem of sticking in the absence of the present invention. Using a penetrating portion with a tapered width in combination with a largest cross-section substantially the same shape as the smallest cross-section of the stabilizing bore allows the biasing plunger to act as a wedge into the stabilizing bore, thus becoming stuck.

Still referring to FIGS. 9A, 9B, and 9C, the largest cross-section of the penetrating portion of the biasing plunger 16 may comprise one or more sharp or rounded vertices 162 with corresponding vertices 220 in the smallest cross-section of stabilizing bore 22. Applicants have found that sticking of the biasing plunger 16 may particularly occur because of a tendency for the vertices 162 on the biasing plunger to act like wedges into the corresponding vertices 220 in the stabilizing bore 22, especially if the biasing plunger is biased in a direction slightly different to that of the longitudinal axis, e.g. as a result of wear in use. Accordingly, in a preferred embodiment, the shape of at least one vertex 162 in a cross-section of the penetrating portion of the biasing plunger 16 is different to the shape of the corresponding vertex 220 in a cross-section of the stabilizing bore 22, so as to form a gap 202 between the vertex or vertices 162 of the biasing plunger and the corresponding vertex or vertices 220 in the interior surface of the stabilizing bore. In other words, the stabilizing bore 22 is enlarged in the vicinity of at least one vertex 162 of the penetrating portion. This change in shape may be achieved, for example, by ensuring that the radius of curvature of at least one vertex of the penetrating portion is different (i.e. larger or smaller) to the radius of curvature of the corresponding vertex of the stabilizing bore. For example, a sharp vertex (a radius of curvature of substantially zero) on the penetrating portion is less likely to wedge into a rounded vertex with a radius of curvature of 1 mm, than it is into another sharp vertex, and vice versa. Similarly, a rounded vertex with a radius of curvature of 1 mm is less likely to wedge into a corresponding rounded vertex with a radius of curvature of 2 mm than into a corresponding rounded vertex with a radius of curvature of 1 mm.

According to the second embodiment of the invention, additionally or alternatively to the first embodiment, and referring to FIGS. 9A, 9B, 11 and 12, stabilizing bore 22 comprises at least one guiding groove 200 in at least a portion of the interior surface of the stabilizing bore 22. Correspondingly, the biasing plunger 16 comprises a guiding protrusion 160 configured to fit into the guiding groove 200 in order to further stabilize the biasing plunger 16 during use and reduce the likelihood of it moving out of alignment, which otherwise may result in the biasing plunger 16 sticking and operating inefficiently. Advantageously, in order to improve smooth movement, the guiding groove 200 runs in a direction substantially parallel to the direction (8 in FIG. 7) of intended movement of the biasing plunger 16. The guiding groove may run to the opening 20 in the surface of the razor 10 in order to provide stability to the biasing plunger 16 throughout a larger range of motion, or it may not reach the opening 20 in order to prevent the biasing plunger 16 from extending too far out of the opening 20, i.e. the end of the guiding groove acts as a stopping point. The guiding protrusion 160 and guiding groove 200 may be of any two complementary shapes in the plane of the cross-section of the biasing plunger 16, for example a semi-circular convex protrusion and a semi-circular concave groove, a triangular guiding groove/protrusion combination or preferably a rectangular or square protrusion and a rectangular or square groove, as shown in FIG. 9A, as this shape provides more potential contact to prevent movement of the biasing plunger 16 in the lateral direction. The guiding protrusion 160 may be a discrete body, like a tooth, or it may extend along at least a portion of the length of the penetrating portion of the biasing plunger 16 like a rail, for example over at least about 10%, at least about 20%, at least about 30%, at least about 50%, at least about 70%, at least about 90% or about 100% of the length of the penetrating portion.

Figure 12:
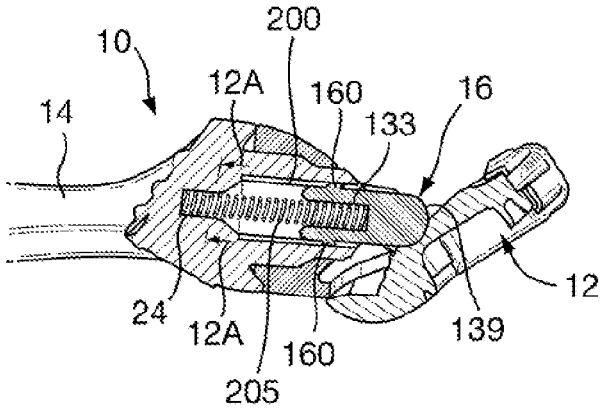
FIG. 12 is a section view of a handle of a razor with a biasing plunger and blade unit attached

In an advantageous embodiment, and referring to FIGS. 9B and 12, the interior surface of the stabilizing bore 22 may comprise a plurality of guiding grooves 200 and correspondingly the biasing plunger 16 may comprise a plurality of guiding protrusions 160 configured to fit into their respective guiding grooves 200, in order to provide more points of anchoring so as to further restrict lateral motion of the biasing plunger 16, particularly in different directions within the lateral plane. In a further advantageous embodiment and still referring to FIGS. 9B and 12, at least a pair of the guiding protrusions 160 and their respective guiding grooves 200 are located on substantially opposing sides of the biasing plunger 16 in order to provide improved points of anchoring to further reduce lateral motion of the biasing plunger 16.

The respective positions of any guiding grooves and guiding protrusions may also be inverted within the scope of the present invention, such that any guiding grooves are part of the biasing plunger 16 and any guiding protrusions are upon the interior surface of the stabilizing bore. Similarly, a mixture of respective positions of any guiding grooves and protrusions may be utilized, e.g. one guiding groove in the plunger complementary to a guiding protrusion on the interior surface of the stabilizing bore in combination with another guiding groove in the interior surface of the stabilizing bore complementary to another guiding protrusion on the biasing plunger.

Biasing Plunger

Referring to FIGS. 1, 6, 7 and 8, razor 10 of the present invention comprises a biasing plunger 16 that biases the blade unit 12 into a rest position. Biasing plunger 16 comprises a penetrating portion configured to reciprocate in or through the stabilizing bore 22 and may be hollow or solid. Biasing plunger 16 comprises a penetrating portion 137 configured to reciprocate through stabilizing bore 22 and may also comprise at least one protrusion 135 which may be equivalent to guiding protrusion 160 or simply serve as a stop to prevent over-extension of plunger 16 beyond opening 20. In an advantageous embodiment, biasing plunger 16 may also comprise an end 139 configured to contact blade unit 12, and especially configured to contact blade unit 12 at cam surface 18. The outer surface of biasing plunger 16 is preferably smooth and also preferably may be lubricated, for example with an oil, water or other liquid or solid material or coating in order to ease reciprocation in or through stabilizing bore 22.

Referring to FIG. 12, the biasing plunger 16 is preferably biased in a direction towards the blade unit 12. The biasing plunger 16 may be biased by a bias-generating member 205, for example a spring or sponge, which may be located to contact a part of the razor 10 and a part of the biasing plunger 16. In particular, the biasing plunger may be spring-biased and as such the razor 10 may further comprise a spring, being the bias-generating member 205. Biasing plunger 16 may further comprise a longitudinal slit (not shown) to enable the biasing plunger to be squeezed to a smaller width in order to ease loading of biasing plunger 16 into razor 10 during manufacture.

Still referring to FIG. 12, the biasing plunger 16 may further comprise a recess 133 at an end of biasing plunger 16 distal from blade unit 12, configured to accept a portion of the bias-generating member 205 at an end of the recess 133 proximal to blade unit 12. Applicants understand that bias-generating members may bend out of shape, particularly after a period of use, so the presence of a recess 133 in the end of the biasing plunger 16 helps to maintain the stability of the bias-generating member 205 and therefore promotes efficient operation of the biasing plunger 16, particularly if the cross-section of the bias-generating member 205 is of the same shape as the cross-section of the recess 133 in the biasing plunger 16. The end 139 of biasing plunger 16 that contacts the surface (e.g. cam surface 18 shown in FIG. 1) of blade unit 12 in order to bias the latter into a rest position may preferably be rounded in order to maintain a good contact throughout the pivoting motion of blade unit 12.

Stabilizing Bore

Figure 12A:
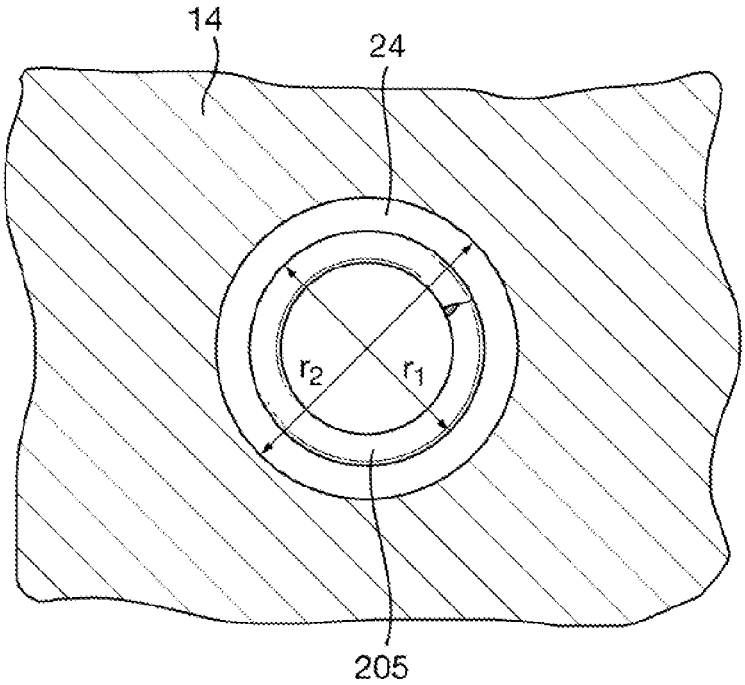
FIG. 12A is a sectional view of part of a handle of a razor taken along line 12A-12A in FIG. 12.

Referring to FIGS. 11 and 12, razors of the present invention comprise a stabilizing bore 22 in which the biasing plunger 16 may reciprocate. The stabilizing bore may have a consistent cross-sectional shape or it may vary along its length. In particular, the stabilizing bore may comprise a narrowed portion 24 at an end distal from blade unit 12, the narrowed portion 24 being configured to accept a portion of bias-generating member 205. As discussed above in relation to biasing plunger 16, the narrowed portion 24 of stabilizing bore 22 helps to further stabilize bias-generating member 205, resulting in an improved efficiency of operation, particularly if the cross-section of the bias-generating member 205 is of the same shape as the cross-section of the narrowed portion 24 of the stabilizing bore 22. In order to prevent excessive lateral motion of the bias-generating member, it is preferable that the dimensions of the cross-section of the narrowed portion 24 are no greater than about 25% larger than the corresponding dimensions of the cross-section of the spring 205, preferably no greater than about 20% larger, more preferably no greater than about 15% larger, even more preferably no greater than about 10% larger and even more preferably still no greater than about 5% larger than the corresponding dimensions of the cross-section of the bias-generating member. By way of example, in the system depicted in FIG. 12A (a cross-section taken through line 12A-12A in FIG. 12) in which the bias generating member 205 and narrowed portion 24 each have a circular cross-section then the radii or diameters ($r_1$, $r_2$) of these circular cross-sections appropriately represent the dimensions to be measured. In the case of biasing members and narrowed portions being of different cross-sectional shapes, then the measurements should be made along the same dimension or direction for the cross-section of the biasing member as for the narrowed portion.

Handle

Figure 4:
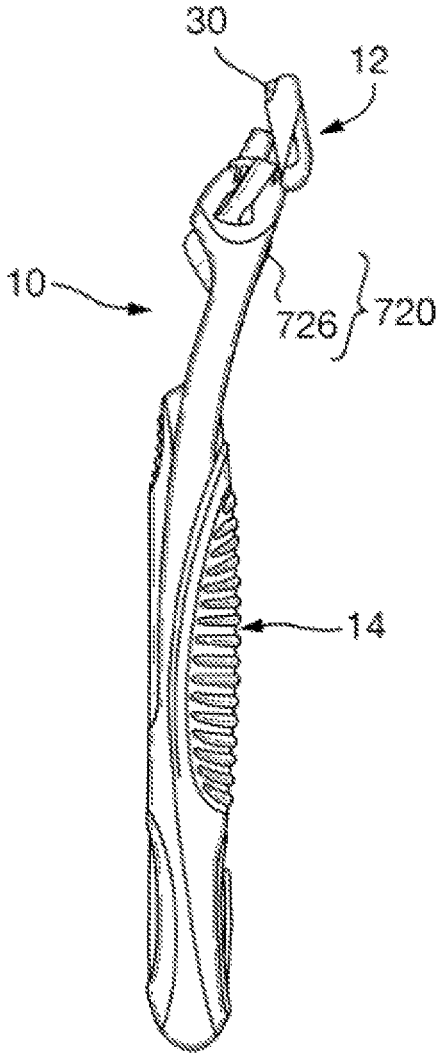
FIG. 4 is a side view of the razor of FIG. 1.
Figure 5:
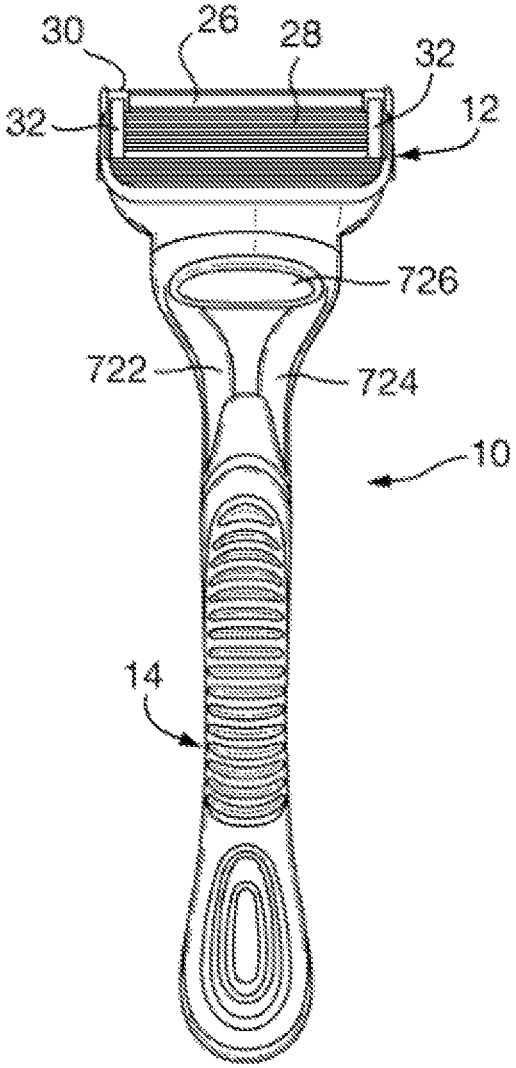
FIG. 5 is a front view of the razor of FIG. 1.
Figure 6:
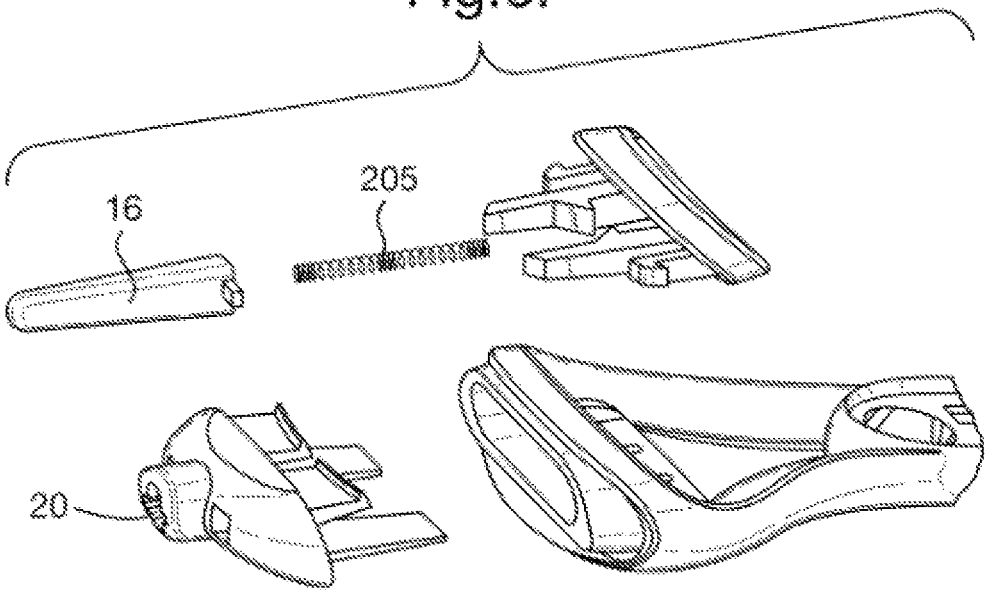
FIG. 6 is an exploded view of part of the handle of FIG. 2A.

Referring to FIGS. 4 and 5, handle 14 may include a single gentle curve 720 being concave on the same side as blades 28. Handle 14 may be bifurcated into two portions 722, 724, providing an empty region between them to provide access to a finger pad 726 which may be located on the concave side of curve 720. The gentle curve 720 on the same side as the primary blades and finger pad 726 and the access to pad 726 provided by the bifurcated handle permit the user to place a thumb or finger in line with and directly under the trimming blade, which may be located on trimming assembly 30 shown in FIG. 4, when trimming sideburns or other whiskers or hairs on user's skin. Finger pad 726 is preferably made of elastomeric material and comprises projections to provide good engagement. The inner surfaces of portions 722, 724 may be relieved to provide access to finger pad 726. Finger pad 726 is preferably a separate member secured to handle 14.

In use, the user rotates handle 14 through 180 degrees from the position in which it is usually gripped such that the thumb is on finger pad 726, and moves the rear of the blade unit toward the skin area to be shaved with trimming blade of trimming assembly 30 in alignment with the edge of the hairs to be trimmed, e.g., at a location desired for a clean bottom edge of side burns or an edge of a mustache or beard or under a user's nose when shaving hairs in this otherwise difficult-to-shave location. The blade unit 12 is located at its rest position with respect to handle 14, and thus does not pivot as the user presses the rear of the blade unit 12 against the skin and then moves it over the skin to trim hairs.

Blade Unit

Figure 3:
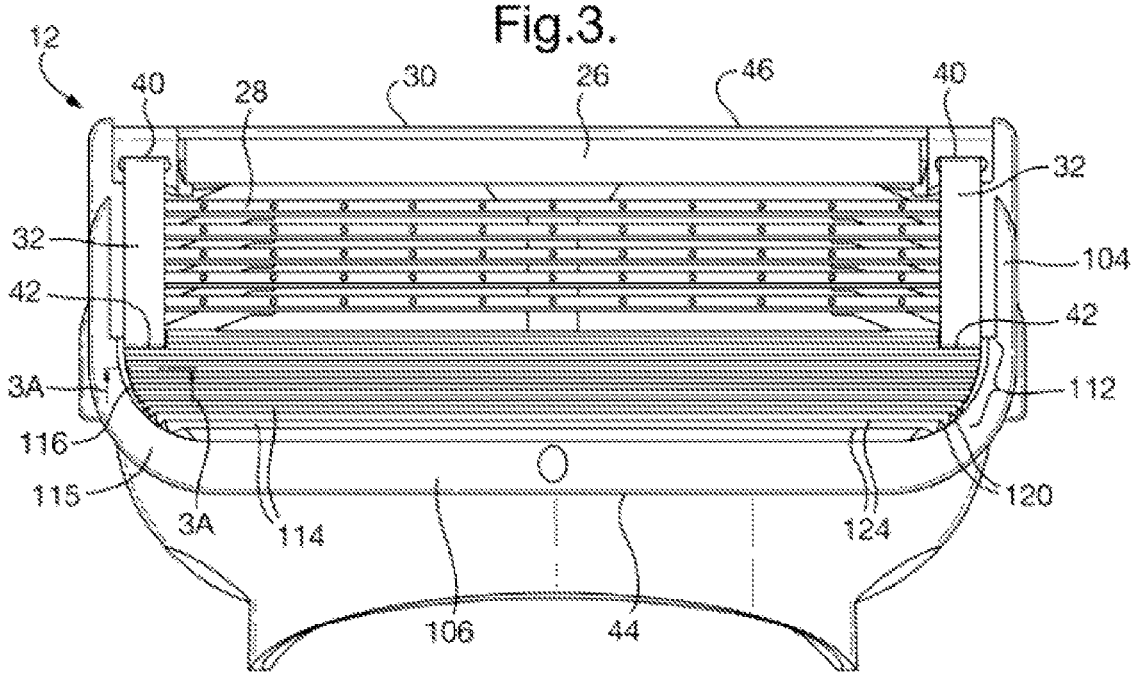
FIG. 3 is a front view of the blade unit of FIG. 2.
Figure 3A:
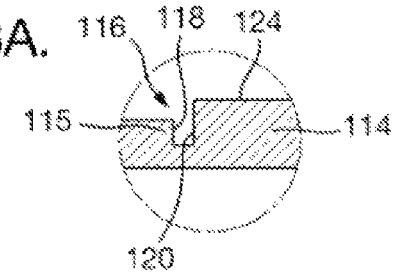
FIG. 3A is a sectional view of an elastomeric member of FIG. 3 taken along line 3A-3A in FIG. 3.
Figure 3B:
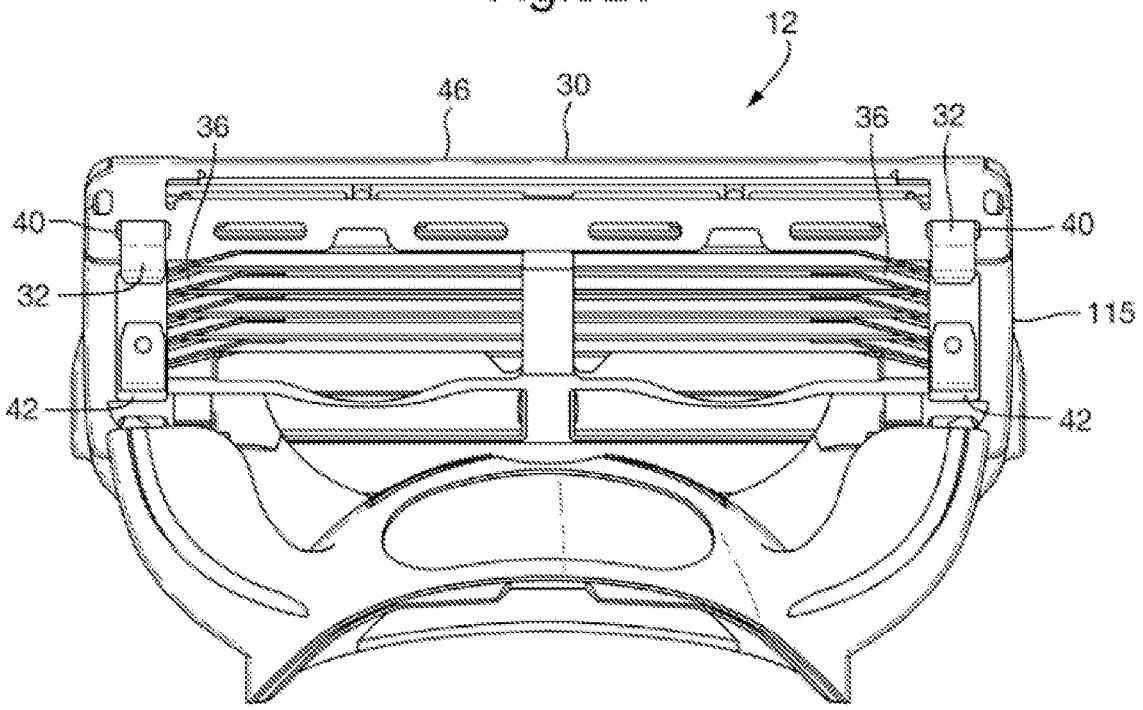
FIG. 3B is a rear view of the blade unit of FIG. 3.
Figure 10A:
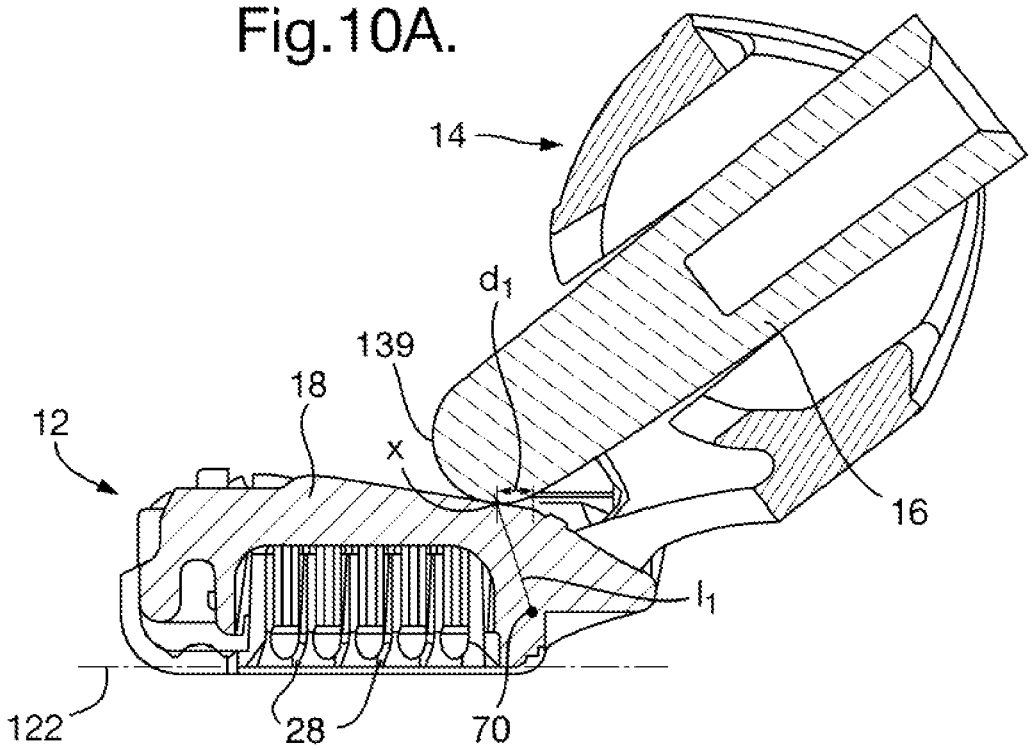
FIG. 10A is a section view of the blade unit of FIG. 3 in the rest position and biasing plunger of FIGS. 7 and 8.

Referring also to FIGS. 3, 3A and 3B, the blade unit 12 may comprise support structure frame 115 having front portion 106, side portions 104, leading edge 44 and trailing edge 46. The housing may further comprise lubricating strip 26 at the rear of blade unit 12, blades 28 within the boundary of frame 115, supports 36 for the blades 28, and trimming assembly 30 attached to the rear of blade unit 12 by clips 32 entering into slots 40,42 and which also retain blades 28 within blade unit 12. Blades 28 are preferably located in a relatively unobstructed region inside frame 115 to e.g. provide for ease of rinsing of the blade unit 12 during use. With reference to FIG. 10A, the one or more blades 28 may be located at a rear portion of the blade unit 12, the rear portion being defined between the pivot axis 70 and the rear edge 46 of the cartridge housing. Referring back to FIG. 3, lubricating strip 26 when present provides a lubricious shaving aid and may be made of a material comprising a mixture of a hydrophobic material and a water leachable hydrophilic polymer material, as is known in the art and described, e.g., in U.S. Pat. Nos. 5,113,585 and 5,454,164, which are hereby incorporated by reference. Blade unit 12 may further comprise at least one group 112 of resilient fins 114 having tips 124 and ends 120, the group 112 preferably being located between blades 28 and front edge 44.

Pivoting Structure

Figure 10B:
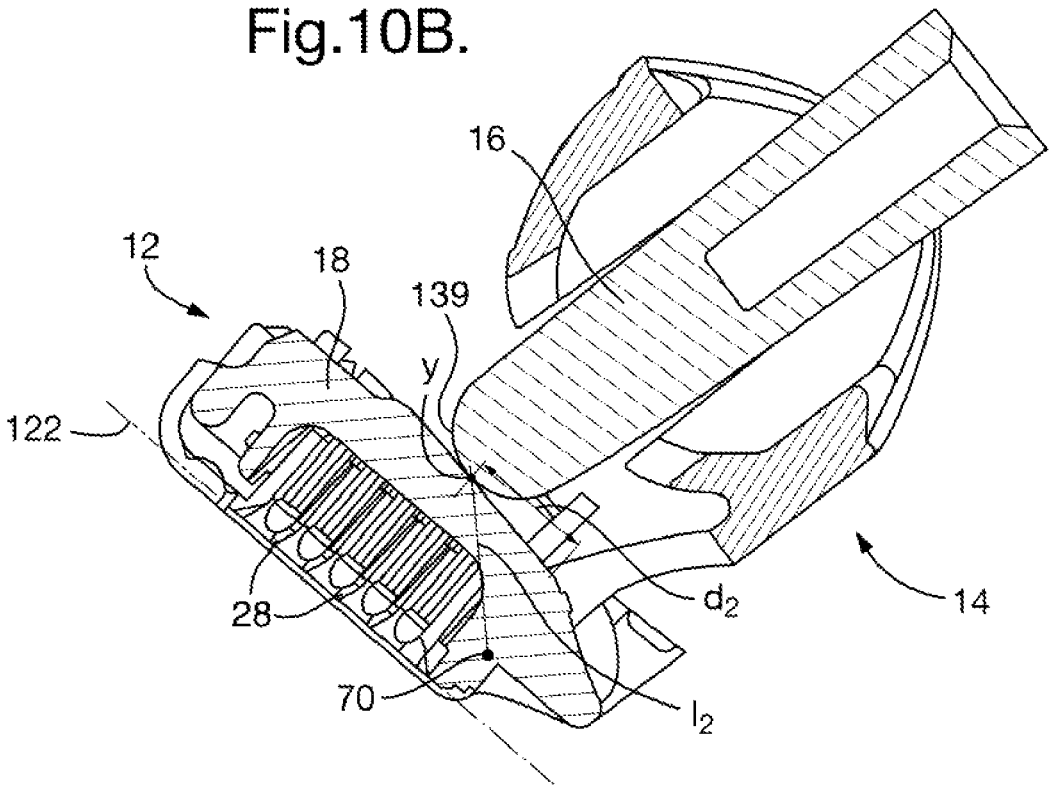
FIG. 10B is a section view of the blade unit of FIG. 3 in the fully rotated position and the biasing plunger of FIGS. 7 and 8.

Referring to FIGS. 1 and 2, blade unit 12 is pivotally connected to razor 10 and so may be inherently pivotally connected to handle 14. The blade unit 12 can pivot about a pivot axis 70 relative to the handle 14 due to cooperating pivot structures provided by the blade unit 12 and handle 14. Referring to FIGS. 10A and 10B, the tips of blades 28 may form a blade plane 122. Biasing plunger 16 may preferably contact cam surface 18 at a point x,y a distance in the blade plane, or plane distance, $d_1$,$d_2$ of no less than about 0.8 mm from pivot axis 70.

In some implementations, biasing plunger 16 contacts cam surface 18 at a point x,y a direct (i.e. shortest) distance $I_1$,$I_2$ from pivot axis 70 of at least about 0.8 mm, preferably at least about 2.5 mm. In some cases, the plane distance $d_1$,$d_2$ varies as the blade unit 12 is rotated or pivoted relative to the handle 14, such as from a minimum distance of about 0.8 mm or more to a maximum distance of about 3.5 mm or less. In some embodiments, a direct distance $I_1$,$I_2$ of a point of contact x,y between biasing plunger 16 and cam surface 18 from pivot axis 70 varies from a minimum of about 3 mm or more to a maximum of about 5 mm or less. As the blade unit 12 rotates or pivots relative to the handle 14, the contact point x,y between the biasing plunger 16 and the blade unit 12 (preferably cam surface 18) changes. The plane distance $d_1$ and the direct distance $I_1$ are each at a minimum at point x when the blade unit 12 is at the biased, rest position, with $d_1$ measured along a line that is perpendicular to pivot axis 70 and parallel to blade plane 122. The horizontal distance $d_2$, also measured along a line that is perpendicular to pivot axis 70 and parallel to blade plane 122, and direct distance $I_2$ are each at a maximum at contact point y when the blade unit 12 is at the fully rotated position. In the embodiment shown, $d_1$ is about 0.9 mm, $I_1$ is about 3 mm, $d_2$ is about 3.5 mm and $I_2$ is about 5 mm. Alternatively, $d_1$ can be between about 0.8 and 1.0 mm, $I_1$ can be between about 2.5 and 3.5 mm, $d_2$ can be between about 3 and 4 mm and $I_2$ can be between about 4.5 and 5.5 mm.

Referring again to FIGS. 1, 7 and 8 the blade unit 12 is biased toward an upright, rest position (shown by FIG. 1) preferably by biasing plunger 16, preferably being a spring-biased biasing plunger. A distal end 139 of biasing plunger 16 contacts blade unit 12, preferably at cam surface 18 (FIGS. 10A and 10B) and at a location spaced from the pivot axis 70 so as to impart a biasing force to blade unit 12 around pivot axis 70. Locating the biasing plunger/blade unit contact point spaced from the pivot axis 70 provides leverage so that biasing plunger 16 can return blade unit 12 to its upright, rest position upon load removal. This leverage also enables blade unit 12 to pivot freely between its upright and fully loaded positions in response to a changing load applied by the user.

Referring now to FIGS. 3, 10A and 10B, as the blade unit 12 is rotated from its rest position, the torque about pivot axis 70 due to the force applied by biasing plunger 16 increases due, at least in part, to the increasing plane distance between the contact point x,y and pivot axis 70 and the rotation of biasing plunger 16 to a more perpendicular orientation to cam surface 18. In some embodiments, the minimum torque applied by biasing plunger 16, e.g., in the rest position, is at least about 1.5 N-mm, such as about 2 N-mm. In some cases, the maximum torque applied by the biasing plunger, e.g., in the fully rotated position, is about 6 N-mm or less, such as about 3.5 N-mm.

The blade unit 12 and handle 14 may be connected such that the pivot axis 70 is located away from plane 122 (e.g., at a location within the blade unit 12) and in front of the blades 28 (e.g. between front edge 44 of blade unit 12 and the blades 28). Positioning pivot axis 70 in front of blades 28 is sometimes referred to as a "front pivoting" arrangement.

The position of the pivot axis 70 between front edge 44 and rear edge 46 of blade unit 12 determines how the cartridge will pivot about pivot axis 70, and how pressure applied by the user during shaving will be transmitted to the user's skin and distributed over the surface area of the razor cartridge. For example, if pivot axis 70 is positioned a distance into the body of blade unit 12 from blade plane 122 and relatively near to the front edge of the housing, so that the pivot axis is spaced significantly from the centre of the width of blade unit 12, the blade unit may tend to exhibit "rock back" when the user applies pressure to the skin through the handle. "Rock back" refers to the tendency of the wider, blade-carrying portion of the blade unit to rock away from the skin as more pressure is applied by the user. Positioning the pivot axis in this manner generally results in a safe shave, but may tend to make it more difficult for the user to adjust shaving closeness by varying the applied pressure.

In blade unit 12, the distance between pivot axis 70 and front edge 44 of blade unit 12 is preferably sufficiently long to balance the cartridge about pivot axis 70. By balancing the blade unit in this manner, rock back is reduced while still providing the safety benefits of a front pivoting arrangement. Safety is maintained because the additional pressure applied by the user will be relatively uniformly distributed between the blades and the support structure 115 rather than being transmitted primarily to the blades, as would be the case in a centre pivoting arrangement (a blade unit having a pivot axis located between the blades). Preferably, the distance from front edge 44 of blade unit 12 to pivot axis 70 is sufficiently similar to the distance from rear edge 46 of blade unit 12 to pivot axis 70 so that pressure applied to the skin through blade unit 12 is relatively evenly distributed during use. Pressure distribution during shaving can be predicted by computer modeling.

Materials for forming razor 10, handle 14, blade unit 12 and biasing plunger 16 can be selected as desired. Preferably, the handle 14 is formed of metal, such as a zinc alloy. The handle casing can, however, be formed of other materials, including plastics (e.g., plated acrylonitrile-butadiene-styrene) and plastics with metal inserts, such as those described by U.S. Pat. No. 5,822,869, herein incorporated by reference. Any suitable method for forming the handle casing can be employed including die casting, investment casting and molding. Suitable materials for forming the blade unit 12 and biasing plunger 16 include thermoplastics. For example, blade unit 12 and biasing plunger 16 may be formed of acetal or polypropylene. Suitable methods for forming include molding, such as injection molding.

Clips

Referring to FIGS. 3 and 3B, clips 32 are secured near respective sides of blade unit 12. Each clip 32 passes through a pair of slots 40 and 42 located between front edge 44 and rear edge 46 of the blade unit 12. Preferably, clips 32 are formed of 5052-H16 Aluminum and are about 0.3 mm thick. As will be described in greater detail below, by locating clips 32 in-board of front and rear edges 44, 46 of blade unit 12 (as shown in FIG. 3), the clips interfere less with certain shaving features of the razor 10. Additionally, by threading clips 32 through slots 40 and 42 in blade unit 12 the clips 32 may be securely mounted on blade unit 12. The clips 32, as noted above, retain the blades 28 within blade unit 12. The blades 28 may additionally be spring biased in which circumstance the clips 32 also locate cutting edges of the spring-biased blades 28 at a desired exposure when in the rest position.

Threading clips 32 through the housing can provide several advantages. For example, a wider blade unit 16 can be provided without substantial increase in length of the clips 32, because the clips 32 are positioned inboard of the blade unit's front and rear edges 44, 46. This is in contrast to, e.g., U.S. Pat. No. 6,035,537, which employs metal clips that wrap around the housing's periphery and over front and rear sides of the blade unit. Also, the legs of the clips 32 are relatively enclosed within slots 40 and 42 of the blade unit 12 and bent over the housing using relatively sharp bends (i.e., bends having a relatively short bend radius). This bend geometry can provide very secure attachment of clips 32 to blade unit 12, making removal of clips 32 from slots 40 and 42 difficult without breaking the clip. Additionally, by forming clips 32 of metal and bending the metal sharply, it can be relatively difficult to straighten the clips sufficiently to pull the bent portions through slots 40, 42.

Blades

Referring to FIGS. 1, 2, 3 and 3B, it is seen that blade unit 12 comprises at least one elongated blade 28 which may be stabilized by at least one support 36. The blade span is defined as the distance from the blade edge to the skin contacting element immediately in front of that edge as measured along a tangent line extending between the element and the blade edge. The cutting edges of each blade are separated from cutting edges of adjacent blades by an inter-blade span distance; the average inter-blade span distance is between about 0.95 mm and about 1.15 mm, preferably between about 1.0 mm and about 1.1 mm and most preferably about 1.05 mm. The blade exposure is defined to be the perpendicular distance or height of the blade edge measured with respect to a plane tangential to the skin contacting surfaces of the blade unit elements next in front of and next behind the edge. Because the cutting edges may rest against clips 32 when at rest, they can be in a common plane, such that the exposures of the three intermediate blades are zero. The front blade may have a negative exposure of −0.04 mm, and the rear blade may have a positive exposure. The decreased exposure on the first blade and increased exposure on the last blade provides for improved shaving performance as described in U.S. Pat. No. 6,212,777.

The increased number of blades tends to desirably distribute compressive forces of the blades against the skin, but will increase the area taken up by the blades if the spans remain the same, with potential difficulties in maneuverability and trimming Reducing spans for an increased number of blades tends to desirably reduce the overall area taken up by blades and to reduce the bulge of skin between cutting edges with a potential improvement in comfort. Reducing the span, however, can reduce the rinsability and ability to clear shaving debris from the blade area. Accordingly, blade unit 12 may additionally comprise a trimming assembly 30, such as one described in U.S. Patent App. No. 20050198841.

In a five-bladed razor, the lower end of the span range of about 0.95 mm provides good comfort but increased potential for problems associated with clearing shaving debris, and the upper end of the span range of about 1.15 mm provides good clearing of shaving debris but potential for skin bulge and decreased comfort, such that span values within the range, and in particular, values closer to the more preferred about 1.05 mm span, provide a good balance of reduced size and good comfort while maintaining sufficient rinsability to avoid shaving debris problems. The distance from the front cutting edge to the rear cutting edge is four times the average inter-blade span and thus is between about 3.8 mm and about 4.6 mm, preferably between about 4.0 mm and about 4.4 mm and most preferably about 4.2 mm, i.e., between about 4.1 mm and about 4.3 mm.

Resilient Fins

Referring again to FIG. 3, the blade unit 12 may comprise a group 112 of resilient fins 114, positioned within a frame 115. Frame 115 may provide a continuous elastomeric surface around the periphery of the fins, which may improve tracking of the cartridge during shaving, and may enhance the skin stretch and tactile properties provided by frame 115. Referring also to FIG. 3A, a groove 116 is provided between a recessed wall 118 of the frame 115 and ends 120 of the fins 114. This groove 116 allows the fins to flex, for example to close together when the leading portion 106 is deflected, rather than being fixed at their ends as would be the case if the fins were joined to the frame 115 at their ends. However, if desired the fins can be joined to the frame, or the frame 115 can be omitted and the fins can extend across the entire dimension of blade housing 12.

In the embodiment shown, group 112 includes 15 fins. Generally, the group 112 of fins 114 may include fewer or more fins 114 (e.g., between about 10 and about 20 fins). For a given pitch and fin geometry, more fins 114 will generally give greater skin stretch, for a closer shave; however, above a certain number of fins skin stretch tends not to increase (or increased skin stretch is not necessary) and the elastomeric member may become overly wide, making it difficult for the user to shave in tight areas.

Referring back to FIG. 23, tips 124 of the elastomeric fins 114 may increase in elevation from the fin furthest from the blades 28 to the fin closest to the blades 28 along a curve. Some of the tips 124 may lie to one side of blade plane 122 some of the tips 124 to the other side of blade plane 122. An increasing elevation of fins 114 tends to gradually increase skin contact. The increasing elevation also causes the tips to conform to the skin during shaving. Fins 114 may have a tip to base height "h" of about 0.4 to about 0.9 mm and a narrow profile, i.e., the fins may define an included angle θ of less than about 14 degrees (preferably between about 14 and about 8 degrees, such as about 11 degrees). The fins 114 may be spaced at a pitch of between about 0.14 mm and about 0.57 mm center-to-center, e.g., 0.284 mm, and may be between about 0.1 mm and about 0.4 mm, e.g., 0.217 mm, thick at their bases. The distance from the front of the first fin to the back of the last fin at the base may be about 4 mm. Alternatively, this distance can be between about 2.5 mm and about 6 mm. The narrow, e.g., about 8 degrees to about 14 degrees fin profile θ improves fin flexibility, which in turn helps stretch the skin, thereby setting up the hairs for improved cutting.

The material for forming the frame 115 can be selected as desired. Preferably, the frame 115 is formed of an elastomeric material, such as block copolymers (or other suitable materials), e.g., having a durometer between 28 and 60 Shore A. Preferably, the fins 114 are also made of a relatively soft material, e.g., having a Shore A hardness of between about 28 and about 60 (for example, between about 40 and about 50, such as between about 40 and about 45 Shore A). As values are increased above this range, performance may tend to deteriorate, and as values are decreased below this range there may be production problems. Fins 114 and frame 115 may be integrally formed of the same material. In other cases, the fins and elastomeric member are formed of differing materials. The method of securing frame 115 to blade unit 12 can also be selected as desired. Suitable methods include, as examples, adhesives, welding and molding (e.g., over-molding or two-shot molding) frame 115 onto blade unit 12.

According to a third embodiment, the present invention relates to a method, especially a cosmetic method, of removing hair or bristles (e.g. whiskers, stubble or other material of similar properties and dimensions) from a surface comprising the steps of providing a razor according to the disclosure above and moving the razor across the surface. In particular embodiments, the hair is unwanted and the surface is skin, or more particularly human skin. The method may further comprise any combination of additional steps such as washing the surface before or after hair removal, for example with a liquid face wash or soap, wetting the surface with a liquid such as water, a shaving aid or an oil before or after removing hair to lubricate or post-treat the surface, applying a shaving preparation such as a shaving gel or foam, particularly before the step of moving the razor across the surface and applying a post-treatment composition such as a cream, balm or lotion, particularly after the step of moving the razor across the surface. Examples of shaving preparations and post-treatment compositions comprise such ingredients as lubricants, surfactants, emollients, moisturizers, sunscreens and the like. Shaving preparations may be in the form of post-foaming gels, mousses, foams or other products that lather spontaneously or require lathering by the user, for example with the hands or a brush. The step of moving the razor across the surface may also be preceded or succeeded by another hair removal operation such as using electric clippers, cutting with scissors, depilatory (chemical) hair removal, epilation (electric or, for example, with wax) or plucking.

According to a fourth embodiment the present invention relates to the use of a razor according to the disclosure above to remove hair or bristles, particularly unwanted hair. The hair is typically removed from a surface and especially for cosmetic reasons. The use of the razor may be in conjunction with other types of hair removal as discussed above or the use of lubricants, shaving preparations or aids, post-treatment compositions, washing compositions or washing/lathering implements.

According to a fifth embodiment of the invention, a shaving kit is provided, comprising at least one razor according to the disclosure above and packaging for the at least one razor. The kit may further comprise any combination of one or more additional razors, spare parts, accessories such as spare blade units (cartridges) or holders for the razor(s) and/or other components. The kit may further comprise any combination of any of the components required or desired to carry out any of the steps in the method according to the third embodiment of the invention or any of the uses according to the fourth embodiment of the invention, for example shaving preparations, post-treatment compositions, depilatory compositions, washing compositions, lubricants, epilatory devices or waxes, tweezers, shaving brushes, clippers, scissors, in addition to further packaging for the razor or any of the foregoing components of the kit.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising a pivotable blade unit which is biased into a rest position by a biasing plunger, the razor comprising a stabilizing bore in which a penetrating portion of the biasing plunger is configured to reciprocate, wherein the largest cross-section of the penetrating portion has a shape which differs from the shape of the smallest cross-section of the stabilizing bore in order to lower the contact area between the penetrating portion of the biasing plunger and the stabilizing bore, wherein the largest cross-section of the penetrating portion of the biasing plunger comprises at least one sharp or rounded vertex and wherein the shape of the vertex in the largest cross-section of the penetrating portion is different to the shape of the corresponding vertex in the smallest cross-section of the stabilizing bore.

2. A razor according to claim 1, wherein a distance between the largest cross-section of the penetrating portion and the smallest cross-section of the stabilizing bore is from about 0.01 mm to about 1 mm.

3. A razor according to claim 1, wherein the pivotable blade unit comprises a front edge and at least one blade, the at least one blade being located so as to pass along a surface being shaved to the rear of the front edge, and wherein the pivotable blade unit pivots around a pivot axis located between the front edge and the one or more blades.

4. A razor according to claim 3, wherein the biasing plunger contacts the blade unit a distance of no less than about 0.8 mm from the pivot axis.

5. A razor according to claim 1, wherein the stabilizing bore defines an interior surface, and wherein the interior surface comprises at least one guiding groove or guiding protrusion and the biasing plunger comprises at least one guiding groove or guiding protrusion configured to fit with the guiding groove or guiding protrusion of the interior surface.

6. A razor according to claim 5, wherein at least one guiding groove runs in a direction substantially parallel to the direction in which the biasing plunger is configured to reciprocate.

7. A razor according to claim 5, wherein the guiding groove comprises an end configured to contact the guiding protrusion in order to arrest the biasing plunger.

8. A razor according to claim 5, wherein the stabilizing bore and penetrating portion of the biasing portion comprise a plurality of guiding grooves and a plurality of guiding protrusions configured to fit into the guiding grooves.

9. A razor according to claim 8, wherein at least two guiding grooves forming a pair of guiding grooves are located on substantially opposing sides of the biasing plunger.

10. A razor according to claim 1, wherein the stabilizing bore comprises an opening through which the biasing plunger may protrude, and wherein the razor further comprises a bias-generating member that contacts the razor at a location distal from the opening of the stabilizing bore, and contacts the biasing plunger.

11. A razor according to claim 10, wherein the plunger further comprises a recess into which the bias-generating member extends.

12. A razor according to claim 10, wherein the stabilizing bore comprises a narrowed portion distal from the opening and into which the bias-generating member extends.

13. A razor according to claim 12, wherein the narrowed portion has a cross-section the same shape as the cross-section of the bias-generating member.

14. A razor according to claim 13, wherein the dimensions of the cross-section of the narrowed portion are no greater than about 25% larger than the corresponding dimensions of the cross-section of the bias-generating member.

* * * * *